US005771942A

United States Patent [19]

Bünger

[11] Patent Number: 5,771,942

[45] Date of Patent: Jun. 30, 1998

[54] METHOD OF ATTACHING FLAT, IN PARTICULAR PLATE-LIKE, COMPONENTS TO A TEXTILE WEB

[75] Inventor: Claus Michael Bünger, Wuppertal, Germany

[73] Assignee: August Bünger Bob-Textilwerk KG GmbH & Co., Wuppertal, Germany

[21] Appl. No.: 809,512

[22] PCT Filed: Sep. 29, 1995

[86] PCT No.: PCT/EP95/03852

§ 371 Date: Mar. 24, 1997

§ 102(e) Date: Mar. 24, 1997

[87] PCT Pub. No.: WO96/12837

PCT Pub. Date: May 2, 1996

[30] Foreign Application Priority Data

Oct. 20, 1994 [DE] Germany ..... 44 37 477.1

[51] Int. Cl.[6] ..... D03D 41/00

[52] U.S. Cl. ..... 139/11; 139/425 R

[58] Field of Search ..... 28/140, 142, 143, 28/100; 139/1 B, 11, 425 R; 66/13, 169 R, 9 R, 170, 171, 202, 1 R, 61, 80; 223/44

[56] References Cited

U.S. PATENT DOCUMENTS 4,205,709 6/1980 Duschek ..... 139/425 R 5,452,591 9/1995 King ..... 66/83

FOREIGN PATENT DOCUMENTS 3929284 6/1994 Germany .

9308632 12/1994 Germany .

9423170 10/1994 WIPO .

*Primary Examiner*—C. D. Crowder

*Assistant Examiner*—Larry D. Worrell, Jr.

*Attorney, Agent, or Firm*—Friedrich Kueffner

[57] ABSTRACT

The invention relates to a method of arranging flat plate-like components at a prepared arrangement location within a textile web of a textile machine. The flat plate-like components are connected by a flexible carrier at a fixed distance from each other so as to form a linear arrangement. The method comprises the steps of providing the linear arrangement of flat plate-like components to a thread tying location on a textile machine along a longitudinal axis, working the flexible carrier into the textile web so that part of the carrier emerges from the prepared arrangement location of the textile web in a free-floating manner and the plate is positioned at a distance upstream of the thread tying location on the textile machine. The floating carrier is then pulled so that the plate passes through the thread tying location of the textile machine and is placed at the prepared arrangement location within the textile web. The plate is then secured in the prepared arrangement location in the textile web by tying the prepared arrangement location.

12 Claims, 3 Drawing Sheets

FIG. 3
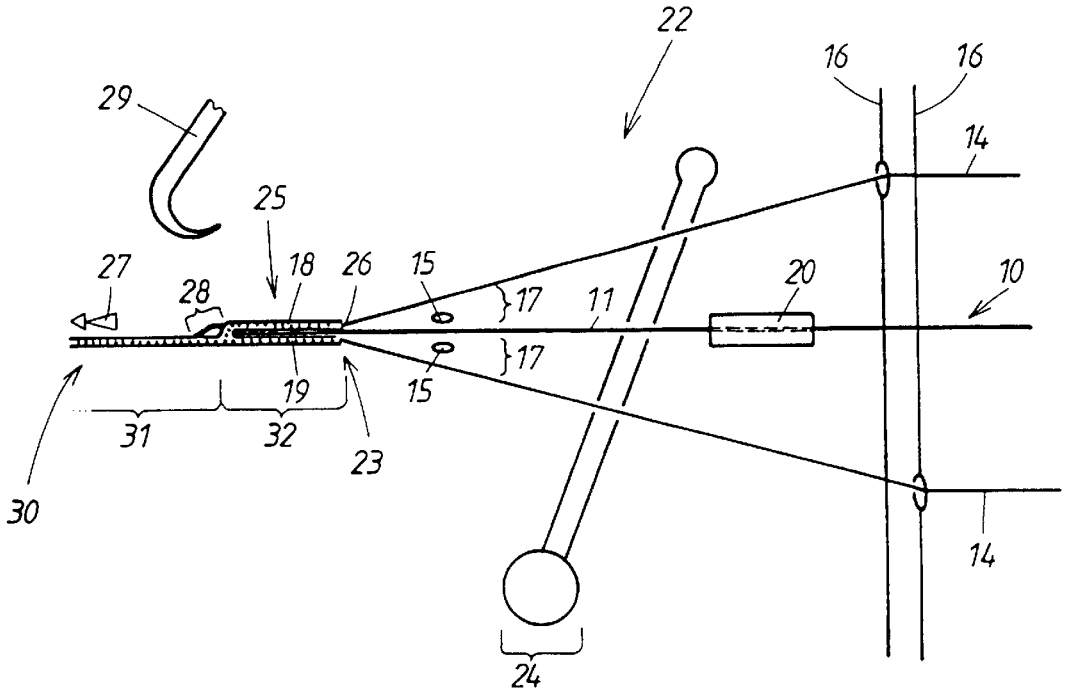
FIG. 4
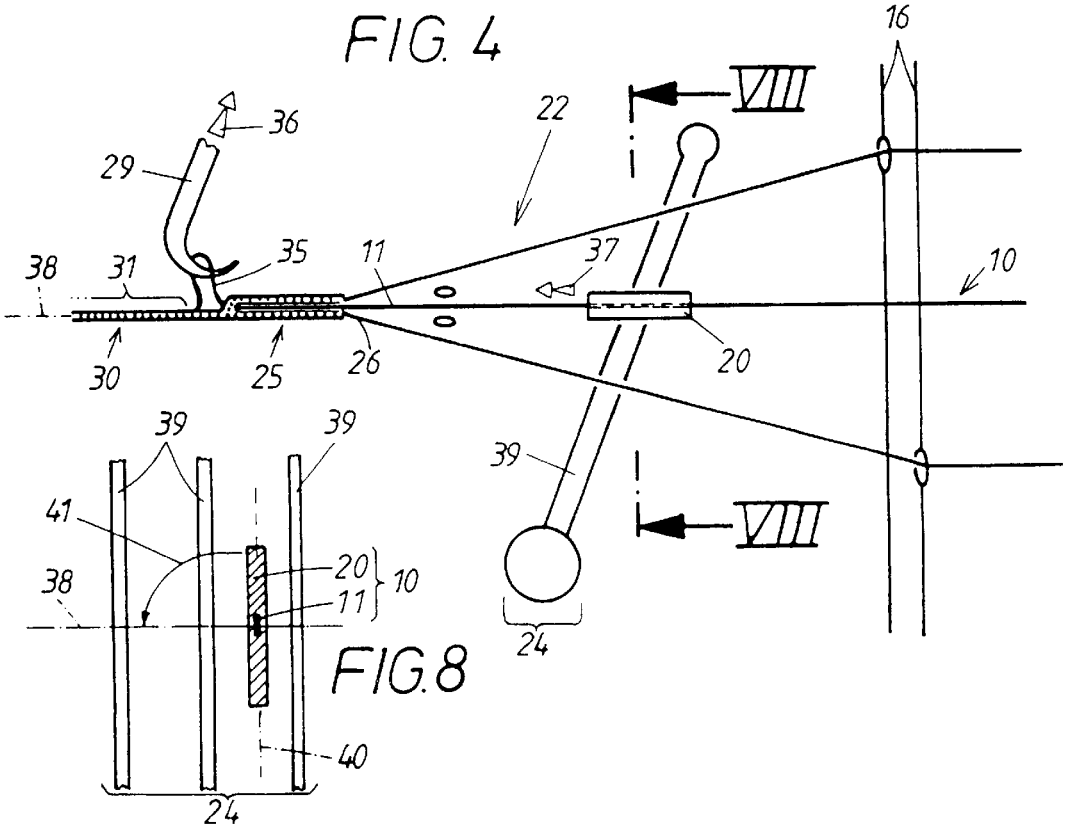
FIG.8

36
29
35
25
15
41
37
11
20
10
22
30
23
20'
15
13
24

36
29
22
35
25
18
20'
26
15
10
38
19
37
15

29
35
22
43
20'
18
42
11
19
25'

METHOD OF ATTACHING FLAT, IN PARTICULAR PLATE-LIKE, COMPONENTS TO A TEXTILE WEB

BACKGROUND

The invention is directed to a method of arranging flat plate-like components at a prepared arrangement location in a textile web of a textile machine. It is important to be able to fix plate-like structural component parts at determined locations on a textile web. These structural component parts will be referred to simply as "small plates" hereinafter.

For instance, to help in achieving an elegant fold configuration in a curtain, it is useful to arrange small stiffening rods, as they are called, in the top edge region and bottom edge region of the curtain. Carrying strips provided with pockets are advisably used for this purpose, these carrying strips being fastened at the edge of the curtain. Such carrying strips are first produced on a weaving machine or loom. The stiffening rods are then inserted into the pockets. Since it is difficult to automate this process, this insertion is performed manually, which is tedious and time-consuming.

Another important application for such methods has to do with a security system for self-serve merchandise. Generally, for this purpose, labels with attached triggers are fastened to the merchandise. When the labeled merchandise comes in proximity to detectors which are placed within the exit area of sales locations, an alarm is triggered unless the alarm trigger in the label has been disabled beforehand. In this connection, it has already been suggested (DE-GM 93 08 632.6) to make label strips with two layers or plies so as to form pockets. These pockets have side pockets opening toward one longitudinal edge of the strip; the alarm trigger must be inserted therein in a cumbersome manner. After they are produced by weaving, the openings of the filled pockets are closed by seams or the like.

The object of the invention is to develop a method of the type mentioned in the preamble which permits a quick, easily automated production of a textile web to be provided with small plates. This object is met in accordance with the invention by the steps given in the characterizing part of claim 1. The particular significance of these steps will be described hereinafter.

The method according to the invention includes, first, a precursor process in which a line forming a linear arrangement of small plates is produced. This line will be referred to hereinafter simply as "plate line". This is effected in that the small plates are connected at a defined, fixed distance from one another with at least one flexible carrier. In so doing, the small plates can alternate with connection pieces of the carrier material to form the plate line. In this case, it is also possible to produce the entire plate line in one piece. An alternative would be to start with an already finished continuous strip at which the carriers are fixed in place at a defined distance from one another.

This precursor process is followed by a main process which is effected in its entirety on the machine used for producing the textile web. This machine will be referred to hereinafter simply as "textile machine". The special character of the method according to the invention consists in that the plate line is allowed to work as a thread element in the textile machine along with the other thread elements of the textile web. When the textile machine used is a weaving loom, the usual thread elements such as warp threads and weft threads are woven with the plate line, namely, by means of the method steps indicated in the characterizing part of claim 1. In general, it is sufficient to form the textile web with one ply and to tie in the small plates to be attached thereto via their carriers with the thread elements of the textile web. A preferred production method is effected in that the textile web is constructed, at least in some areas, so as to have two plies in the form of pockets as is indicated more fully in claim 5.

Further advantages and steps of the invention are given in the further subclaims, the following description and the drawings. An embodiment example of the invention is shown in the drawings.

BRIEF DESCRIPTION OF THE DRAWINGS

FIGS. 3–7 show schematic views of a plurality of consecutive method steps for producing, by weaving techniques, the textile web, shown in FIG. 1, with the plate line from FIG. 2;

FIG. 8 shows a schematic enlarged view of a partial section through the textile machine along section line VIII—VIII from FIG. 4.

DETAILED DESCRIPTION

Figure 2:
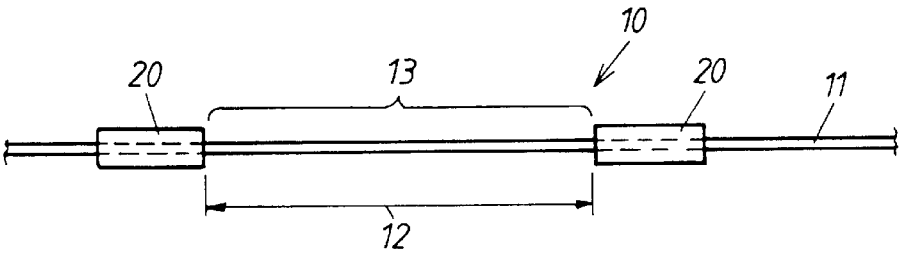
FIG. 2 is a schematic top view of a prepared plate line for the textile web used in FIG. 1.

FIG. 2 shows an embodiment example of the plate line 10 mentioned above. In the present case, this embodiment example is formed of a continuous strip 11 to which are fastened the above-mentioned plates 20 at a defined distance 12 from one another. Thus, this strip 11 is a continuous support or carrier 11 on which the small plates 20 are fastened in a precursor process by gluing, welding, clamping or the like.

As an alternative to the production of a plate line 10 of this kind, carrier portions 13 could be used in the intervening region 12 between the two small plates 20, each end of this portion 13 being fastened to consecutive small plates 20. In this case, it would also be possible for the small plates 20 on the one hand and the carrier portions 13 extending between these small plates 20 on the other hand to be produced in one piece. The plate line 10 could then be produced by punching and/or longitudinal profiling as a continuous configuration with alternately arranged carrier portions 13 on the one hand and small plates 20 on the other hand. This one-piece production is useful, for example, when curtain stiffening rods which are generally made of plastic are to be used as small plates.

The continuous carrier 11 or the carrier portions 13 can be configured as a sheet or thread. As a rule, the carrier 11 lies in the longitudinal axis of the plate line 10, but the small plates 20 could also be connected by a plurality of parallel carriers 11. It is advantageous for the rotation of the small plates in the textile machine, as will be discussed hereinafter, to use two carriers 11 arranged at a distance from one another laterally. In every case, it is critical for the invention to obtain a plate line 10 with a linear arrangement of a plurality of small plates 20 which are arranged at a defined distance from one another. This plate line 10 is now used like a thread element in a textile machine which, along with the other usual thread elements, serves to produce a textile web 30. A textile web 30 of the this kind can have one ply or can be two-ply in some areas. The textile machine can be a weaving loom or knitting machine, for example.

Figure 1:
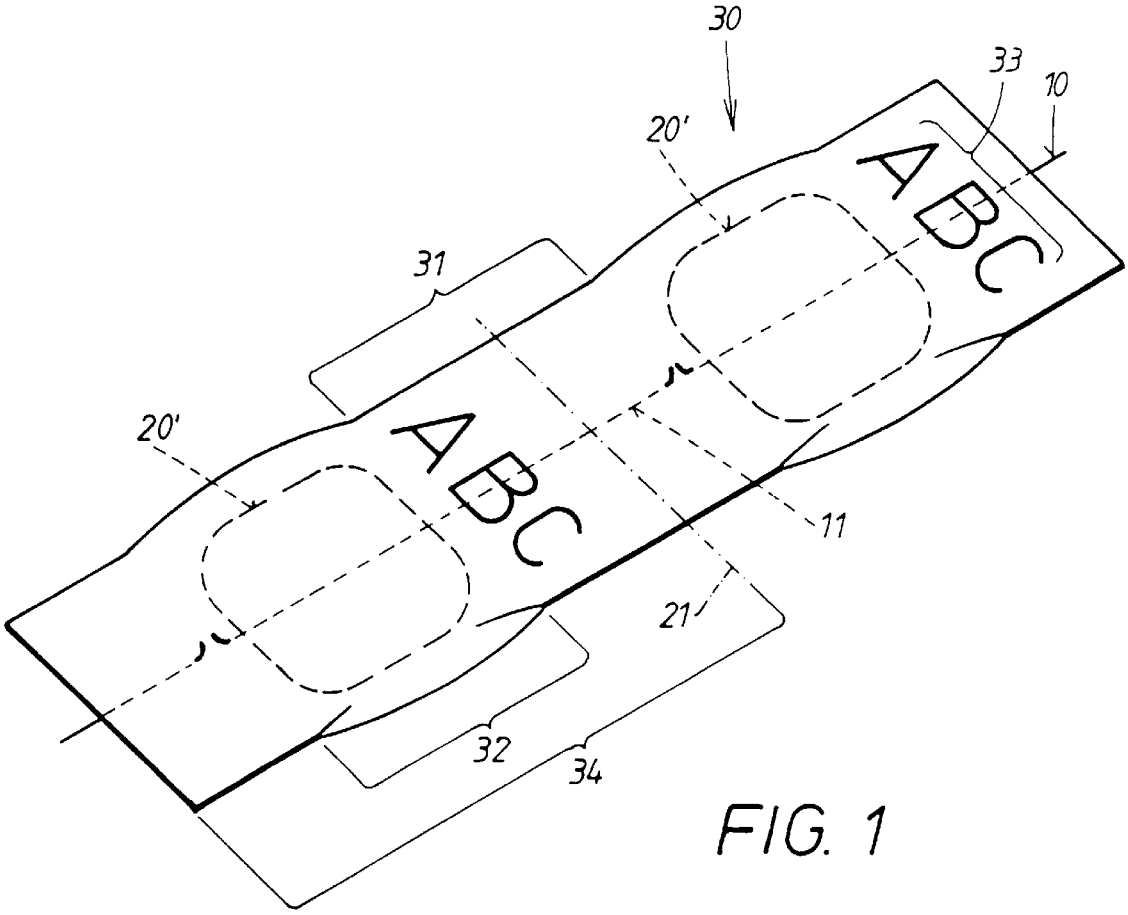
FIG. 1 is a schematic perspective view of part of a textile web formed as a label strip with small plates which are designed as alarm triggers and are integrated therein.

In the embodiment example shown in FIG. 1, a woven label strip serves as a textile web. This label strip 30 is produced continuously with alternating two-ply web regions 32 and one-ply intermediate web pieces 31. The small plates 20' are integrated by weaving techniques into the two-ply web regions 32 in a parallel layer relative to the web plane and, in the present embodiment example, are "alarm triggers" which were mentioned above and which make up part of a security system for merchandise. In accordance with its labeling function, the label strip 30 is provided with graphic and/or alphanumeric information 33 which can be woven in or printed on subsequently. As is conventional in labels, this information 33 includes the name of the merchandise, instructions for its use and cleaning and/or composition of the merchandise and its provenance. The finished label strip 30 shown in FIG. 1 which has been outfitted with the alarm triggers 20 in the manner described above is divided into individual label portions 34 by cutting along the cutting locations 21 indicated by dash-dot lines in FIG. 1. These individual label portions 34 are then fastened to the respective merchandise which is to be safeguarded against theft. The small plates 20' functioning as alarm triggers contain appropriate elements such as electric coils and electric capacitors which cooperate with detectors that are tuned to these elements and set off alarms when the labeled merchandise enters the area of the detectors.

FIGS. 3 to 7 show different method steps for producing such a combination of small plates 20, 20' and the textile web 30 on a weaving machine 22. In this case, the plate line 10 is introduced in the weaving machine 22 as a kind of warp thread and cooperates in a manner consistent with weaving technique with the rest of the thread elements such as the warp threads 14 and weft threads which are introduced in the woven fabric by the weft insertion means 15 illustrated in FIGS. 3 to 7. The plate line 10 is worked in as a "warp thread" in the running direction of the textile web 30. The warp threads 14 are controlled by thread control elements such as the indicated heddles 16 which, depending on the weaving program, produce a shed 17 in which the weft insertion means 15 move. The decisive tying together of the respective thread elements formed of the weft, warp 14 and plate line 10 is effected at that weaving location of the machine 22 designated by reference number 23. In that location, the transversely extending picks or weft threads of the weft insertion means 15 are beaten up by a reed 24. In the present instance, a self-contained reed 24 is used. However, instead of this, an open reed or the like could also be used for beating up the inserted filling threads at the weaving location 23.

FIG. 1 shows a first working phase in the production of the textile web 30. The above-mentioned two-ply web region 32 has just been produced at weaving location 23, namely as a pocket 25 opening toward weaving location 23. The carrier 11 of the plate line 10 extends freely in the interior of the pocket 25 between the two pocket plies 18, 19. The carrier 11 projects out of the pocket opening 26. In this work phase, the small plate 20 of the plate line 10 is located, as viewed in the forward feed direction 27 of the woven textile web 30, just before the working area of the reed 24 which is shown in its rearmost reversing point. The pocket 25 has been produced with a sufficient pocket length such that the small plate 20 can subsequently be received in the interior as will be explained with reference to FIG. 6. In order to produce the two pocket plies 18, 19, a double shed is formed, as shown in FIG. 3, in the region of the two-ply web area 32. In this double shed, the warp threads 14 lie not only in an upper shed and in a lower shed, but also in a center shed, not shown, in which the plate line 10 with its carrier 11 is also located in the present case. In the interest of simplicity, this is not shown in FIG. 3. In accordance with the double shed formed in this way, two weft insertion devices 15 can be introduced simultaneously as illustrated in FIG. 3. One of these weft insertion devices 15 forms the upper textile ply 18 of the pocket 25 while the other forms the lower textile ply 19 of the pocket 25.

In the single-ply web piece 31 in front of the pocket 25, the plate line 10 with its carrier 11 can be worked into the woven fabric. However, the carrier 11 has a float 28 at least in the pocket region. This floating part 28 of the carrier 11, which is already shown in FIG. 3, is preferably provided in the transition between the one-ply web region 31 and two-ply web region 32. However, the float 28 can also extend at its exit point at one pocket 25 to the preceding pocket.

Associated with this floating carrier piece 28 are pulling means 29 operating in cooperation with the rest of the working means of the textile machine 22. When the weaving of the still open pocket 25 is completed, the pulling means 29 which can be formed, for instance, by the hook shown in FIGS. 3 and 4, engage in the floating piece 28 and pull it to form a kind of loop 35. While one end of this loop 35 is fixed in the single-ply web piece or at the preceding pocket, the other loop end which extends farther into the interior of the pocket 25 can be drawn through. When the pulling means 29 are moved in the direction of the pulling movement indicated by arrow 36 in FIG. 4, the carrier 11 is drawn increasingly into the interior of the pocket and the small plate 20 moves in the direction of the pocket opening 26 as indicated by arrow 37 in FIG. 4 showing the push direction.

FIG. 4 shows the position of the plane of the textile web 30 by the dash-dot line 38 in FIG. 4. This is shown again in the enlarged sectional view in FIG. 8 which is a schematic enlarged view of part of the reed 24 with a plurality of reed wires or reed dents 39. After the loop 35 is pulled 36, the small plate 20 is located in the region of the reed 24, as is illustrated in FIGS. 4 and 8. In this region at the latest, but preferably prior to this in the region of the thread control means 16, the small plate 20, with reference to its plane 40 indicated in dash-dot lines in FIG. 8, extends substantially vertically relative to the textile web plane 38. Thus, the small plate 20 is "upended" and easily fits between the warp threads, the heddles of the thread control means, and the reed dents 39 shown in FIG. 8. Guiding means can be provided for this vertical guiding of the small plates 20. Surfaces, guide rails or the like are suitable for this purpose.

Figure 5:
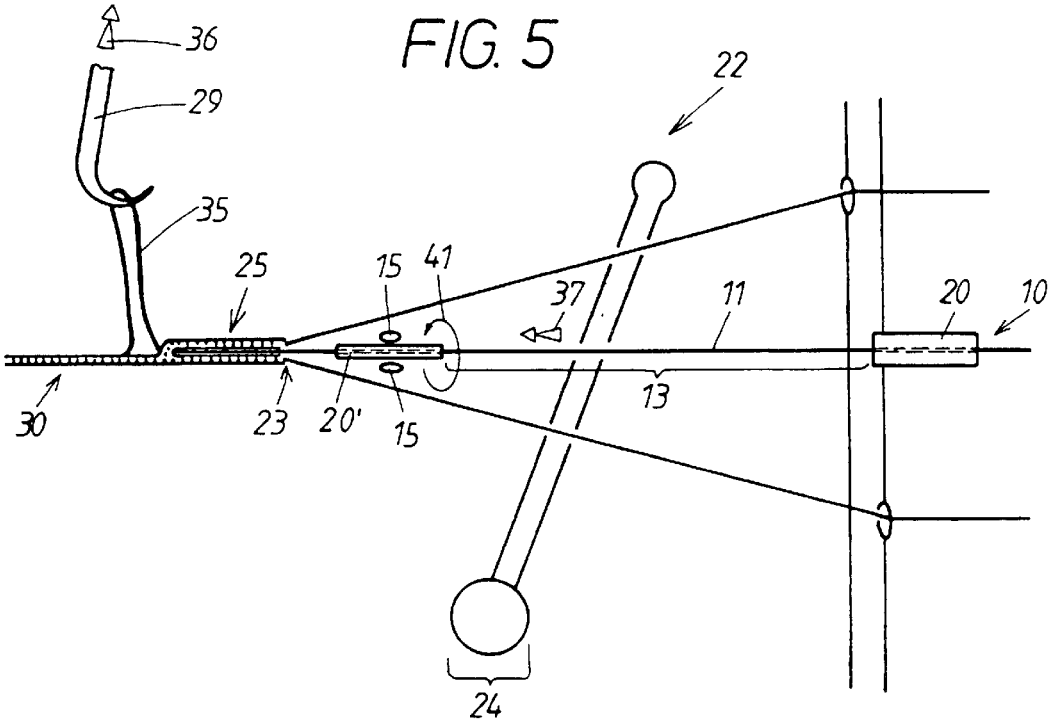
Figure 6:
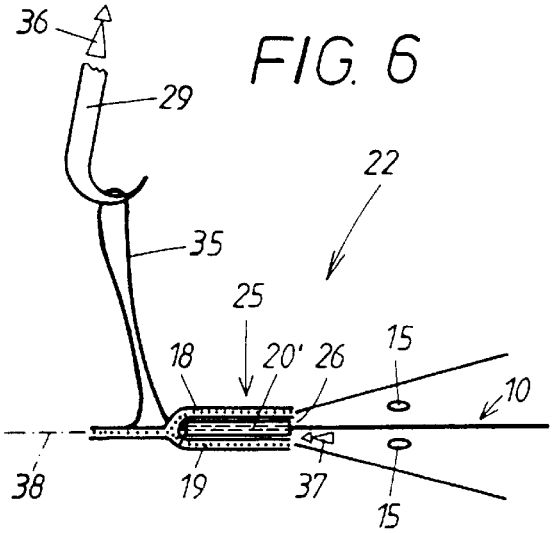

No further working movement of the reed 24 is effected while the pulling means 29 are being pulled in the direction of arrow 36. This can be accomplished by interrupting the weaving of the textile machine 22 or in that the pulling movement 36 indicated in FIGS. 4, 5 and 6 is carried out so quickly that the reed 24 moves only a little during this period of time. In the latter case, it is not necessary to interrupt the weaving. In the next work phase shown in FIG. 5, the loop 35 has already been pulled out so far by the pulling means 29 that the small plate 20 is located in the region of the weft insertion means 15.

As is shown in FIG. 5, it is critical that the small plate be moved out of the vertical position 20 shown in FIGS. 4 and 8 in the rotating direction indicated by arrow 41 into a substantially horizontal position 20' shown in FIG. 5 as the pushing in movement 37 takes place. This is also shown in dash-dot lines in FIG. 8, where the rotation which is to be effected at the other side beyond the reed dents 39 is likewise indicated. Guiding means can be used for this rotation 41. It would also be possible to carry out this function by the weft insertion means 15. While this small plate is situated in its horizontal position 20', the next small plate which is located at a distance axially therefrom is still in the vertical position 20 as shown in FIG. 5. The carrier 11 is sufficiently flexible to enable torsion in the rotating direction indicated by arrow 41 in the carrier portion 13 lying therebetween. The length of the carrier portion 13 can be so dimensioned that the following small plate located in its vertical position 20 is already located in the region of the thread control means 16 and/or in the region of the work movement of the reed 24.

FIG. 6 shows the end position of the pulling movement 36 of the pulling means 29. The push-in movement 37 of the horizontal small plate 20' is concluded because the small plate 20' contacts the base wall of the pocket 25. The loop 35 has reached its maximum loop length. The small plate 20' is located in the interior of the pocket between the two pocket plies 18, 19.

The weaving process now continues from FIG. 6. As can be seen from FIG. 7, the two pocket plies 18, 19 are closed and the formation of a single-ply web piece recommences, producing a pocket closure 42 shown in FIG. 7. The pocket opening 26 which is still discernible in FIG. 6 is now closed. The small plate 20' which is positioned parallel to the textile web plane 38 is surrounded on all sides by the two textile plies 18, 19. The open pocket 25 from FIG. 6 becomes a self-enclosed capsule 25' with a small plate 20' integrated therein.

Figure 7:
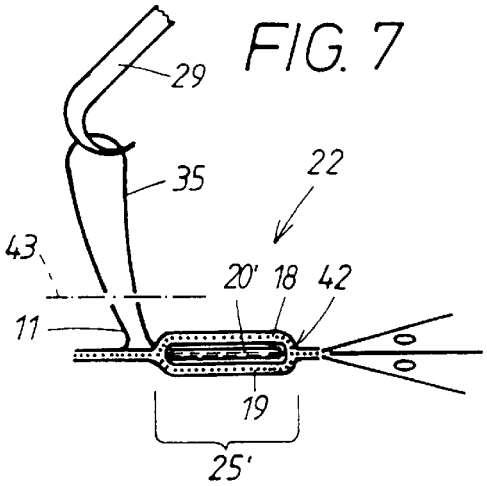

When the textile machine 22 reaches the work phase shown in FIG. 7, the produced loop 35 has achieved its purpose. The carrier 11 for the small plates 20 or 20' can be severed at the base area of the loop 35. This is done if the loop detracts from the appearance of the final product. The severing cut 43 is indicated by a dash-dot line in FIG. 7. The severed loop 35 can be removed. The loop 35 can also be removed in some other way than by cutting it off, e.g., by melting or dissolving it. The loop 35 is advisably cut off while still on the textile machine 22, but may also be cut off subsequently outside of the textile machine if need be. Knife devices conventional in looms such as those used to produce woven Velours can be used to make the severing cut 43.

As was already mentioned, single-ply web portions can also be used instead of pockets as defined arrangement locations in a textile web 30. The small plates are then fixed in their horizontal position 20' by the carriers 11 which are woven into the single-ply woven fabric on both sides of the small plate 20'.

The textile web 30 need not be produced in the form of a woven strip as shown in FIG. 1. Rather, it could also be produced as a wide web of woven fabric which is only cut into strips subsequently. This longitudinal cutting of the wide fabric is advisably effected while still on the textile machine 22. A textile web to be produced as a wide web thus has a plurality of adjacent locations for arranging the small plates 20', e.g., in the form of the pockets 25 which were mentioned above. They are simultaneously produced adjacent to one another in the textile machine. A plate line 10 is fashioned at each of these arranging locations. At the completion of the above-mentioned weaving process according to FIG. 7, a wide woven fabric with a plurality of adjacent small plates 201 is obtained. This wide woven web is then cut along its length between two adjacent pockets 25 in a subsequent method step shown in FIG. 7 as was already mentioned, resulting in a group of web strips. Knives, heated blades or wires, or ultrasonic tools can be used to cut along the length in this way. The result is the label strip shown, for example, in FIG. 1 when pockets are used as locations for arranging the small plates 20'. These web strips need then only be divided into individual portions 34 by transverse cuts 21 as was mentioned with reference to the label strip 30 shown in FIG. 1.

REFERENCE NUMBERS

10 small plate line, first thread element of 32
11 strip, carrier
12 spacing between 20
13 carrier portion between 20
14 warp thread, second thread element
15 weft insertion means for third thread element
16 heddle, thread control means
17 shed produced from 14
18 upper textile ply of 25 or 32
19 lower textile ply of 25 or 32
20 small plate (in vertical position), alarm trigger
20' horizontal position of 20
21 cutting location in 30 (FIG. 1)
22 textile machine, weaving machine
23 weaving location of 22, thread tying location
24 reed of 22
25 pocket in 30
25' closed pocket, capsule, location for arranging 20'
26 pocket opening of 25
27 forward feed direction of 30, longitudinal direction of web
28 floating piece of 11
29 pulling means for 35
30 textile web, woven label strip
31 single-ply intermediate web piece
32 double-ply web region of 30
33 alphanumeric data in 30
34 portion of 30, individual label
35 loop from 11 (FIGS. 4 to 6)
36 arrow indicating pulling movement of 29
37 arrow showing pushing in movement of 20 or 20'
38 plane of textile web
39 reed dent of 24
40 small plate plane of 20
41 arrow showing rotation of 20 into 20' (FIGS. 5 and 8)
42 pocket closure in 25'
43 severing cut line for 35 (FIG. 7)

I claim:

1. A method of arranging flat plate-like components at a prepared arrangement location within a textile web of a textile machine, said flat plate-like components connected by a flexible carrier at a fixed distance from each other so as to form a linear arrangement of flat plate-like components, said method comprising the steps of:

providing said linear arrangement of flat plate-like components to a thread tying location on a textile machine along a longitudinal axis;

working said carrier into said textile web so that part of the carrier emerges from said prepared arrangement location of said textile web in a free-floating manner to form a free-floating loop portion, and wherein said plate is positioned at a distance upstream of the thread tying location on the textile machine;

pulling said free floating loop portion so that said plate passes through the thread tying location of the textile machine and is placed at the prepared arrangement location within the textile web; and securing said plate in said prepared arrangement location in the textile web by tying said prepared arrangement location.

2. The method according to claim 1, wherein said flexible carrier is a continuous strip and said plate-like components are fastened onto said continuous strip at a fixed distance from each other.

3. The method according to claim 1, wherein said flexible carrier is pulled along a linear axis when said free-floating loop portion is pulled.

4. The method according to claim 3, further comprising the additional step of:

removing said free-floating loop portion from said textile web after said securing step.

5. The method according to claim 1, wherein said textile web comprises first and second plies, said method further comprising the additional step, before said providing step, of:

producing a pocket in the textile web so as to be open toward the thread tying location.

6. The method according to claim 5, wherein said first and second plies of said textile web are single ply intermediate web pieces.

7. The method according to claim 5, wherein said floating carrier portion is introduced at the intersection of said pocket and said textile web.

8. The method according to claim 1, wherein said textile web defines a web axis, said method comprising the additional step, before said providing step, of:

rotating said vertically extending plate about its axis so that said plate extends parallel to said web axis.

9. The method according to claim 8, wherein said vertically extending plate is rotated in said thread tying location.

10. The method according to claim 8, wherein said plate is rotated by guide surfaces.

11. The method according to claim 8, wherein said plate is rotated by weft needles.

12. The method according to claim 1, wherein a plurality of arrangement locations for the plate-like components are produced adjacent to one another in the textile web at thread tying location, and wherein the linear arrangement is worked in as a thread element at each of the arrangement locations, and wherein the textile web is cut along its length between two adjoining arrangement locations to form a group of web strips, and wherein the web strip is divided between two small plates arranged thereon and associated with the same linear arrangement to form individual web strip portions.

* * * * *